US006527656B1

(12) United States Patent
Cheng et al.

(10) Patent No.: US 6,527,656 B1
(45) Date of Patent: Mar. 4, 2003

(54) TWO-PIECE GROMMET ASSEMBLY FOR A SPORTS RACQUET

(75) Inventors: Po-Jen Cheng, Oak Brook, IL (US); William D. Severa, West Chicago, IL (US); Kristin M. Bachochin, Libertyville, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/995,183

(22) Filed: Nov. 27, 2001

(51) Int. Cl.[7] ..... A63B 49/00
(52) U.S. Cl. ..... 473/540; 473/539; 473/548
(58) Field of Search ..... 473/539, 540, 473/541, 548

(56) References Cited

U.S. PATENT DOCUMENTS

| | | | | |
|---|---|---|---|---|
| 3,642,283 A | | 2/1972 | Wilkens | |
| 4,066,260 A | | 1/1978 | Rodgers, Jr. | |
| 4,204,681 A | | 5/1980 | Hall, Jr. et al. | |
| 4,220,335 A | | 9/1980 | Nobbs | |
| 4,314,699 A | | 2/1982 | Bayer et al. | |
| 4,331,331 A | | 5/1982 | Rodgers, Jr. | |
| 4,614,626 A | | 9/1986 | Frerking | |
| 4,765,620 A | | 8/1988 | Janes | |
| 4,889,337 A | | 12/1989 | Todd | |
| 4,913,434 A | | 4/1990 | Fischer | |
| 5,092,016 A | | 3/1992 | Soong | |
| 5,102,132 A | | 4/1992 | Chen | |
| 5,137,274 A | | 8/1992 | Soong | |
| 5,290,031 A | | 3/1994 | Natsume | |
| 5,368,297 A | * | 11/1994 | Liu | 473/539 |
| 5,762,570 A | | 6/1998 | Shaw | |
| 5,944,624 A | | 8/1999 | Davis et al. | |
| 5,944,625 A | | 8/1999 | Janes et al. | |
| 5,993,337 A | | 11/1999 | Janes et al. | |
| 6,074,315 A | * | 6/2000 | Yimoyines | 473/539 |
| 6,217,466 B1 | * | 4/2001 | Yimoyines | 473/539 |
| 6,254,499 B1 | | 7/2001 | Tarleton | |
| 2002/0039937 A1 | | 4/2002 | Bothwell | |

FOREIGN PATENT DOCUMENTS

| | | | | |
|---|---|---|---|---|
| EP | 241 393 A1 | | 10/1987 | |
| EP | 241 393 B1 | | 10/1987 | |
| JP | 2002-65903 | * | 3/2002 | A63B/49/02 |

* cited by examiner

*Primary Examiner*—Raleigh W. Chiu
(74) *Attorney, Agent, or Firm*—Terence P. O'Brien

(57) ABSTRACT

A two-piece grommet assembly for a sports racquet. The sports racquet includes a frame having a plurality of grommet holes and at least one racquet string. The grommet assembly includes first and second grommet members. The first grommet member includes a first strip and at least two spaced-apart barrels extending generally perpendicular from the first strip. Each barrel includes a first string hole and is configured to extend through a separate grommet hole in the frame. The second grommet member includes a second strip and at least two spaced-apart pegs extending generally perpendicular from the second strip. Each peg has a second string hole. The second strip contacts the first strip, and the pegs extend into the barrels such that the first and second string holes are generally co-axially aligned. The first grommet member is configured to substantially isolate the pegs and the second strip from the frame.

42 Claims, 10 Drawing Sheets

TWO-PIECE GROMMET ASSEMBLY FOR A SPORTS RACQUET

FIELD OF THE INVENTION

The present invention relates generally to a sports racquet. In particular, the present invention relates to a two-piece grommet assembly for a sports racquet that reduces the risk of premature string failure while improving the overall feel of the racquet.

BACKGROUND OF THE INVENTION

Sport racquets, such as tennis, racquetball, squash and badminton racquets, are well known and typically include a frame having a head portion coupled to a handle assembly. The head portion forms a hoop having inner and outer surfaces and a number of grommet holes, which are typically drilled through the inner and outer surfaces of the head portion. A grommet assembly extends around at least a portion of the outer surface of the hoop and includes a number of inwardly extending, spaced-apart barrels that align with and extend into the grommet holes. A racquet string then extends through the barrels of the grommet assembly. The grommet assembly prevents direct contact between the racquet string and the hoop portion enabling the head portion to support the racquet strings in tension.

Existing racquets are typically strung using plastic or nylon grommets. These nylon or plastic materials are generally hard, often having a durometer of above 50 on the Shore D hardness scale range. This hard grommet material is wear resistant and useful for preventing premature string failure. However, the generally hard grommet assemblies do little to dampen the substantial shock and vibration generated from the impact of the racquet with a ball. Such impacts typically create a shock wave that travels from the racquet head portion, up the handle, and to the hand, arm and shoulder of the user. This shock and vibration can be harsh, uncomfortable, and even harmful, to certain users. At a minimum, the shock and vibration can negatively affect the user's feel of the racquet and can provide the user with a negative impression of the racquet. Although the grip provides some cushioning or dampening effect, the grip alone does not substantially reduce the shock and vibration felt by the user.

In an attempt to reduce this shock and vibration at the strings before it travels to the frame, some racquets have included grommets made of a softer material such as thermoplastic rubber in a Shore A hardness scale range. These softer materials are more effective at dampening shock and vibration, but the stresses applied to, and movement of, the string can cause the grommet assembly to wear often leading to contact between the string and the roughened edges of the frame, ultimately resulting in premature string failure.

Others have attempted to provide an improved grommet assembly with impact dampening characteristics. These grommet assemblies include a base strap formed of a relatively hard material and having a number of inwardly projecting sleeves also made of a relative hard material and a separate soft tubular insert extending into the distal end of each sleeve. Although this configuration generally protects the string from contact with the outer surface of the frame, the soft tubular inserts do not prevent the frame from contacting the hard base strap and sleeves. As a result, the insert does little to further reduce the shock and vibration generated by the racquet during impact with a ball.

In another attempt to provide an improved grommet assembly with impact dampening characteristics, one existing grommet assembly includes a base strap, a number of inwardly projecting sleeves, and an outer strap made. The base strap and the sleeves are made of a nylon based material. The outer strap is formed into the outer surface of the base strap and also into a proximal end of the sleeves. The outer strap further extends through the base strap to contact the outer surface of the frame at locations between the sleeves. However, the nylon based material of the base strap and the sleeves has low shock and vibration dampening properties. Further, the contact between the hard outer strap with the frame limits the ability of the grommet assembly to dampen shock and vibration.

Thus, there is a continuing need for a grommet assembly that minimizes the amount of shock and vibration felt by the user from impact with a ball. There is also a continuing need for a sports racquet having an improved grommet assembly that provides a user with an improved feel and a more pleasing acoustic response during use. What is also needed is a grommet assembly that reduces or eliminates the risk of premature string damage due to contact with the frame.

SUMMARY OF THE INVENTION

The present invention provides a two-piece grommet assembly for a sports racquet. The sports racquet includes a frame having a plurality of grommet holes and at least one racquet string. The grommet assembly includes first and second grommet members. The first grommet member includes a first strip and at least two spaced-apart barrels. The first strip has a first inner surface for contacting the frame and a first outer surface. The barrels extend generally perpendicular from the first inner surface. Each barrel includes a first string hole extending along a longitudinal axis of the barrel. Each barrel is configured to extend through a separate grommet hole in the frame. The second grommet member includes a second strip and at least two spaced-apart pegs. The second strip has a second inner surface and a second outer surface. The pegs extend generally perpendicular from the second inner surface. Each peg has a second string hole. The second inner surface contacts the first outer surface and the pegs extend into the barrels such that the first and second string holes are generally co-axially aligned. The first grommet member is configured to substantially isolate the pegs and the second inner surface from the frame.

According to a principal aspect of the invention, a sports racquet includes a frame, a two-piece grommet assembly, and at least one string. The frame includes a head portion with an outwardly facing surface and an inwardly facing surface that defines a generally oval stringing area. The head portion includes a plurality of grommet holes. Each grommet hole extends through the outwardly facing surface and the inwardly facing surface along an axis. The two-piece grommet assembly includes first and second grommet members. The first grommet member includes a first strip and at least two spaced-apart barrels. The first strip has a first inner surface, for contacting the outwardly facing surface, and a first outer surface. The barrels extend generally perpendicular from the first inner surface. Each barrel extends through a separate grommet hole in the head portion and has a first string hole extending from a proximal end of the barrel to a distal end of the barrel. The second grommet member includes a second strip and at least two spaced-apart pegs. The second strip has a second inner surface and a second outer surface. The pegs extend generally perpendicular from the second inner surface. Each peg has a second string hole. The second inner surface contacts the first outer surface and the pegs extend into the barrels such that the first and second string holes are generally co-axially aligned. The first grommet member is configured to substantially isolate the pegs and the second inner surface from the frame. The string extends through the first and second string holes.

According to another preferred aspect of the invention a two-piece grommet assembly for a sports racquet wherein the sports racquet includes a frame having a plurality of grommet holes and at least one racquet string. The grommet assembly includes first and second grommet members. The first grommet member is made of a first material, such as a natural rubber, a synthetic rubber, a thermoplastic urethane, an elastic polymeric material or combinations thereof. The first grommet member includes a first strip and at least one barrel. The first strip has a first inner surface and a first outer surface. The at least one barrel extends generally perpendicular from the first inner surface. Each barrel includes a first string hole extending along a longitudinal axis of the barrel. Each barrel is configured to extend through a separate grommet hole in the frame. The second grommet member is made of a second material. The second grommet member includes a second strip and at least two spaced-apart pegs. The second strip has a second inner surface and a second outer surface. The pegs extend generally perpendicular from the second inner surface. Each peg has a second string hole. The second inner surface contacts the first outer surface and the pegs extend into the barrels such that the first and second string holes are generally co-axially aligned. The first material has a durometer on Shore A hardness scale that is less than the durometer of the second material on either the Shore A hardness scale or the Shore D hardness scale.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
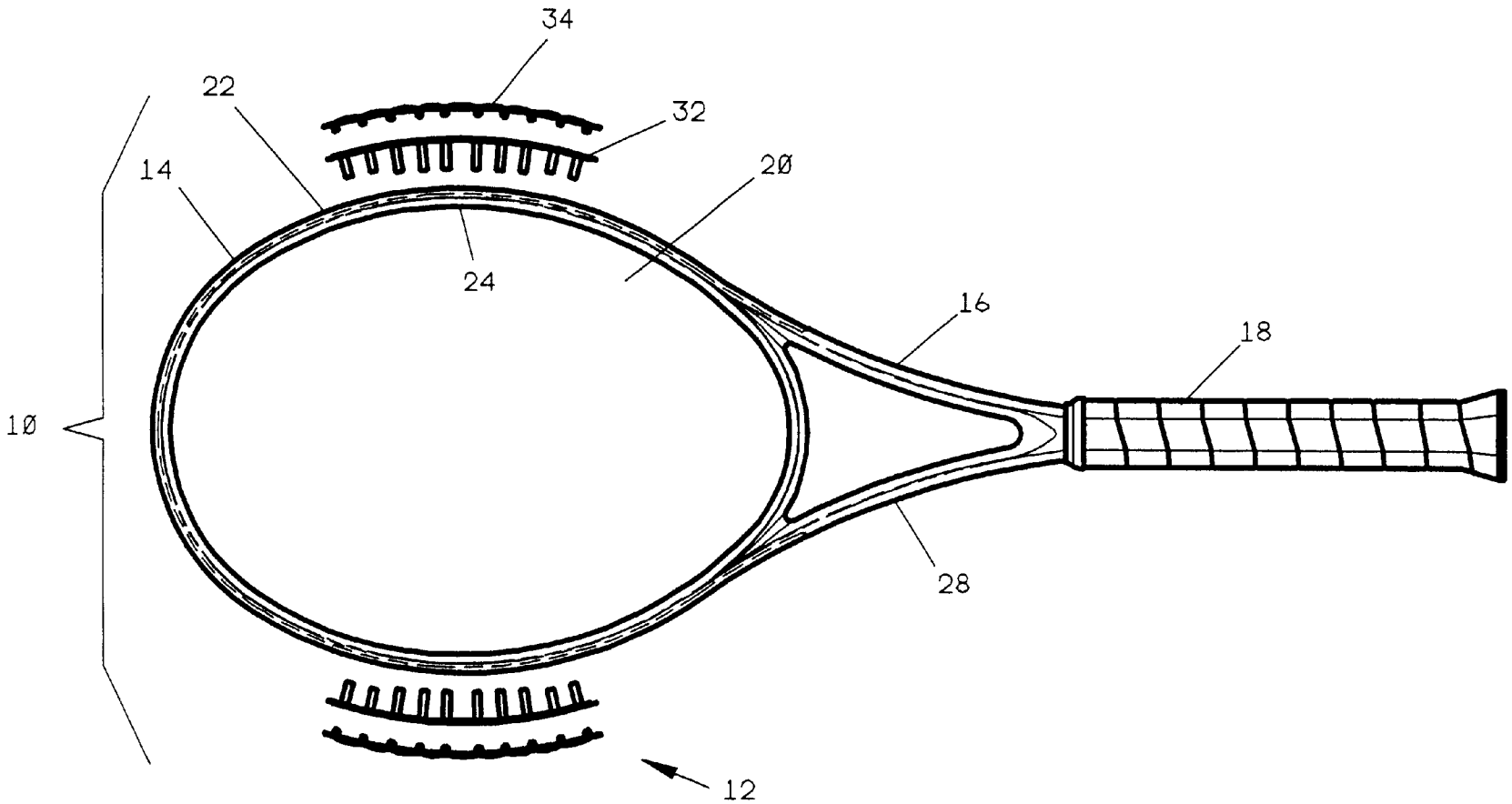
FIG. 1 is a front, exploded perspective view of a racquet in accordance with a preferred embodiment of the present invention.

Referring to FIG. 1, a sports racquet is indicated generally at 10. The racquet 10 of FIG. 1 is configured as a tennis racquet, however, the invention can also be formed as other types of sports racquets, such as, for example, a racquetball racquet, a squash racquet, or a badminton racquet. The racquet 10 includes a frame and a two piece grommet assembly 12. The frame defines a head portion 14, a throat region 16 and a handle assembly 18. The head portion 14 is a tubular structure defining a generally oval shaped opening 20 for supporting a latticework of strings (not shown) in tension. The head portion 14 has an outwardly facing surface 22, an inwardly facing surface 24, and a plurality of grommet holes 26 (see FIG. 10) extending through the inwardly and outwardly facing surfaces 24 and 22. The throat region 16 includes a pair of tubular shafts 28 outwardly extending from the head portion 14 and converging at the handle assembly 18. The throat region 16 couples the head portion 14 to the handle assembly 18. In one preferred embodiment, the pair of tubular shafts 28 is integrally formed with the head portion 14 and the handle assembly 18. In an alternative preferred embodiment, the throat region 16 can include an elastomeric isolator (not shown) positioned between the pair of tubular shafts 28 and the head portion 14. The handle assembly 18 connects to and outwardly extends from the throat region 16.

The grommet assembly 12 is a two-piece, flexible elongate structure removably attached to at least a portion of the head portion 14. The grommet assembly 12 is configured to receive at least one racquet string 30 (see FIG. 10) to facilitate support of the racquet string 30, and to prevent direct contact between the racquet string 30 and the generally roughened edges of the hoop portion 14 at the grommet holes 26. The grommet assembly 12 includes first and second grommet members 32 and 34. In a preferred embodiment, two separate grommet assemblies 12 are positioned at approximately the three and nine o'clock positions on the head portion 14 of the racquet 10, when viewing the racquet 10 from the front side with the opening 20 in full view and the handle assembly 18 downwardly extending from approximately the six o'clock position of the head portion 14.

Figure 2:
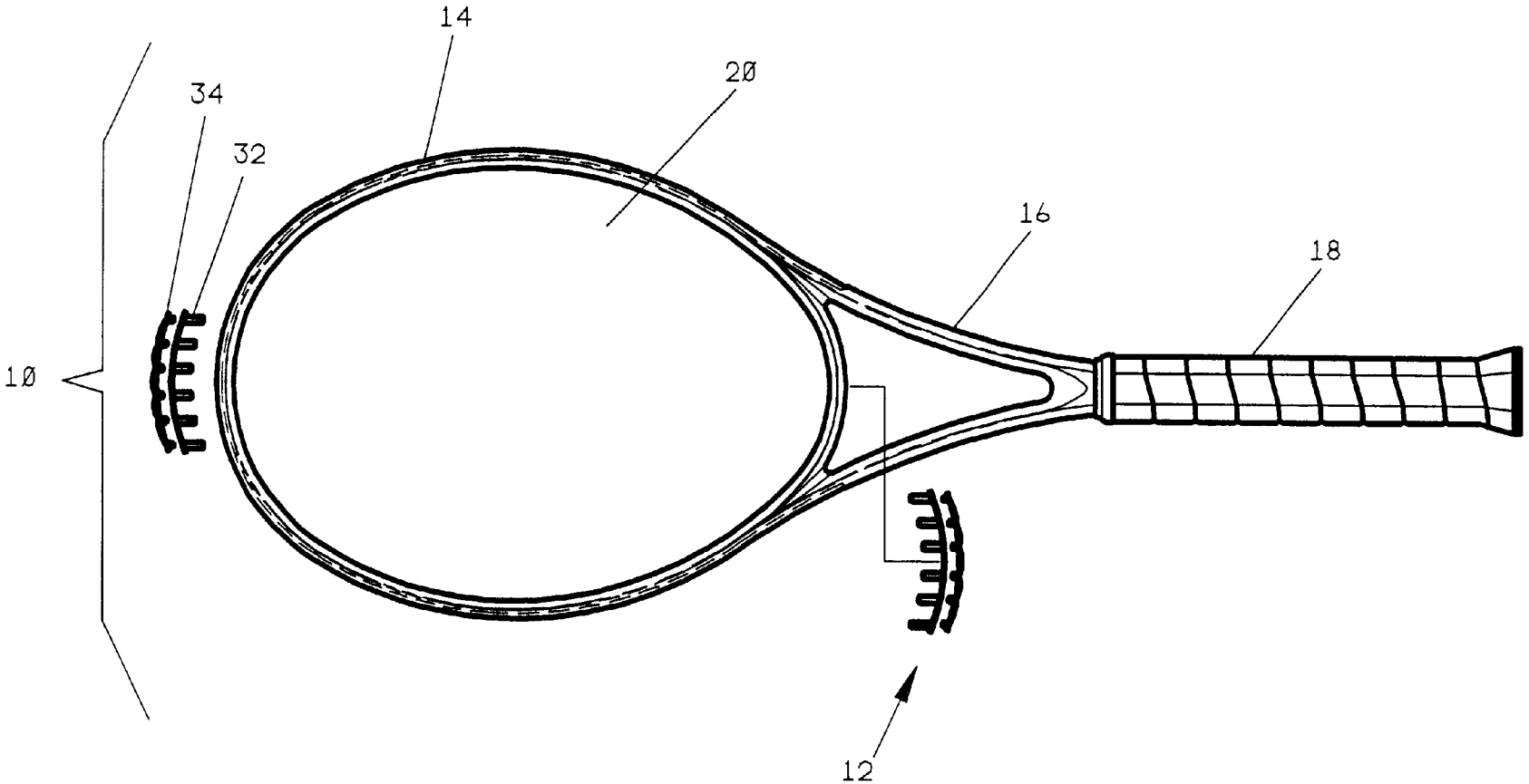
FIG. 2 is a front, exploded perspective view of a racquet in accordance with an alternative preferred embodiment of the present invention.
Figure 3:
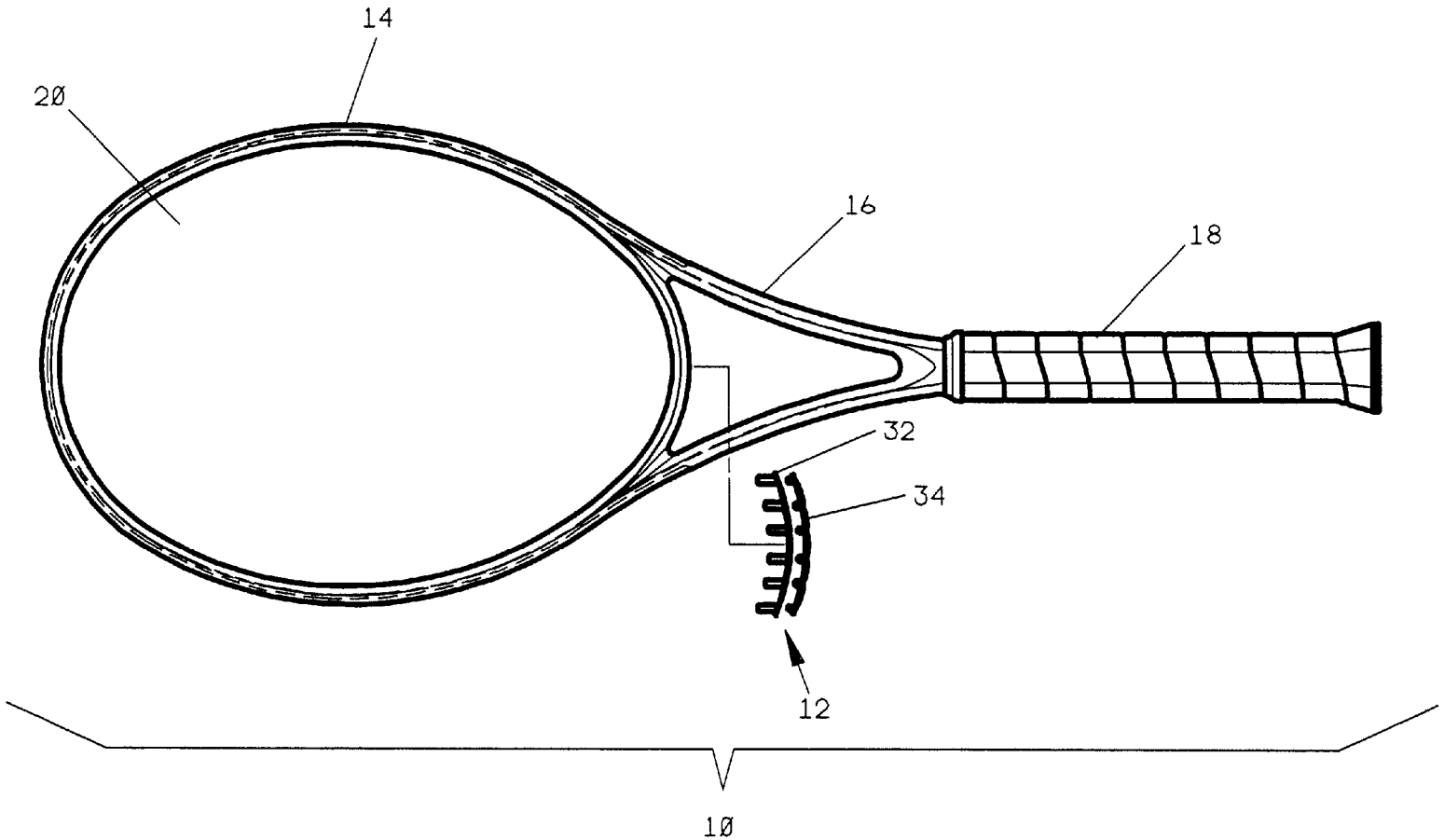
FIG. 3 is a front, exploded perspective view of a racquet in accordance with another alternative preferred embodiment of the present invention.
Figure 4:
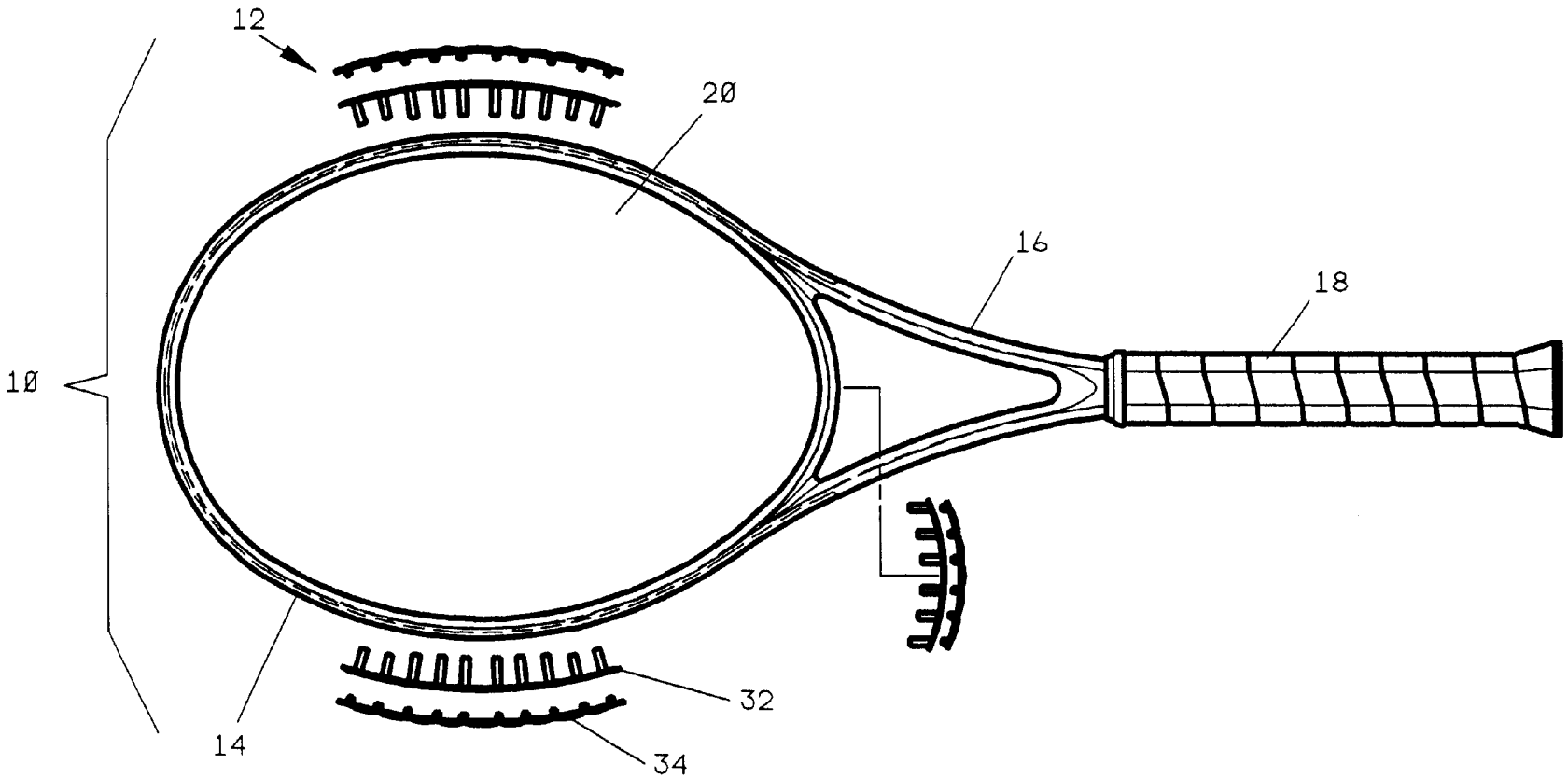
FIG. 4 is a front, exploded perspective view of a racquet in accordance with another alternative preferred embodiment of the present invention.
Figure 5:
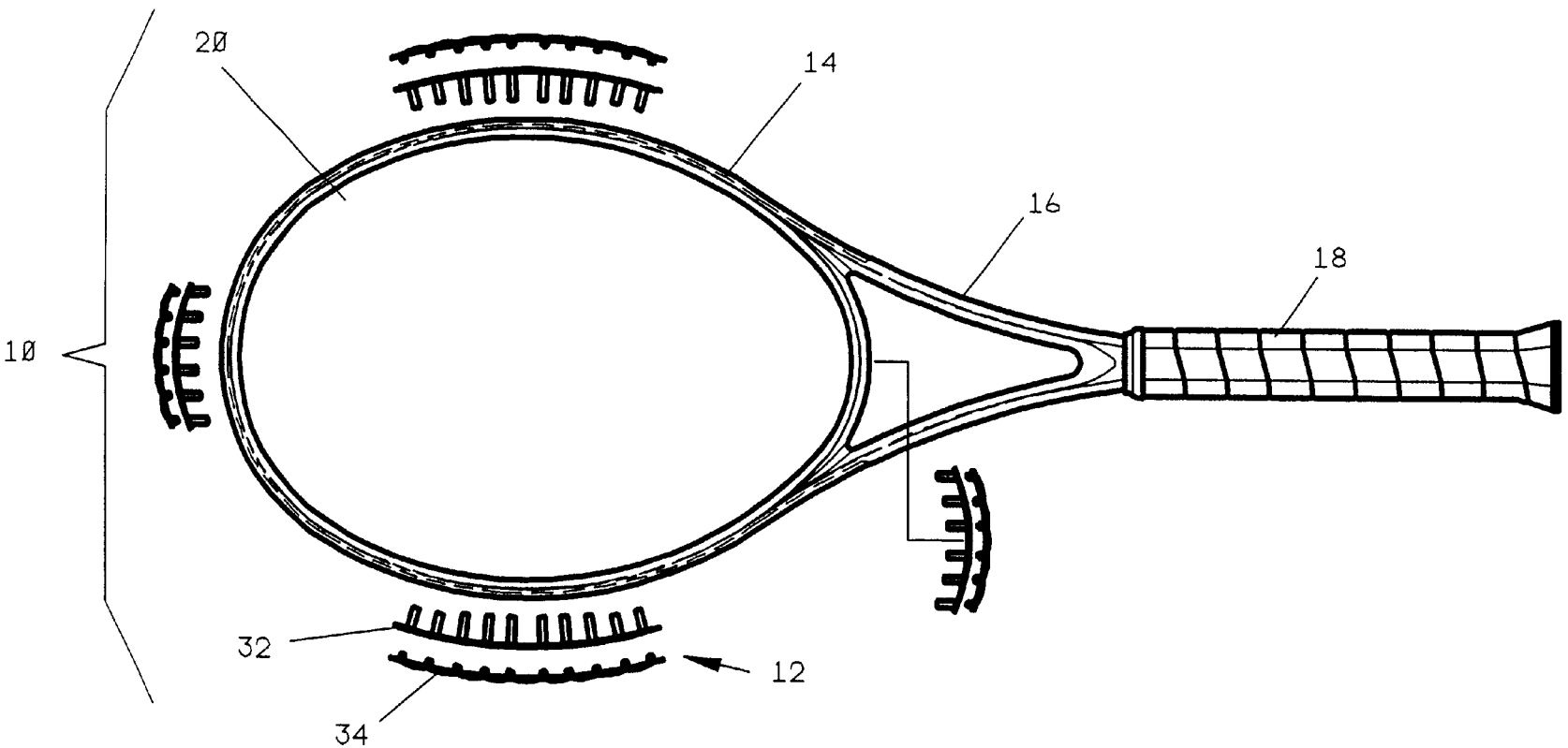
FIG. 5 is a front, exploded perspective view of a racquet in accordance with another alternative preferred embodiment of the present invention.
Figure 6:
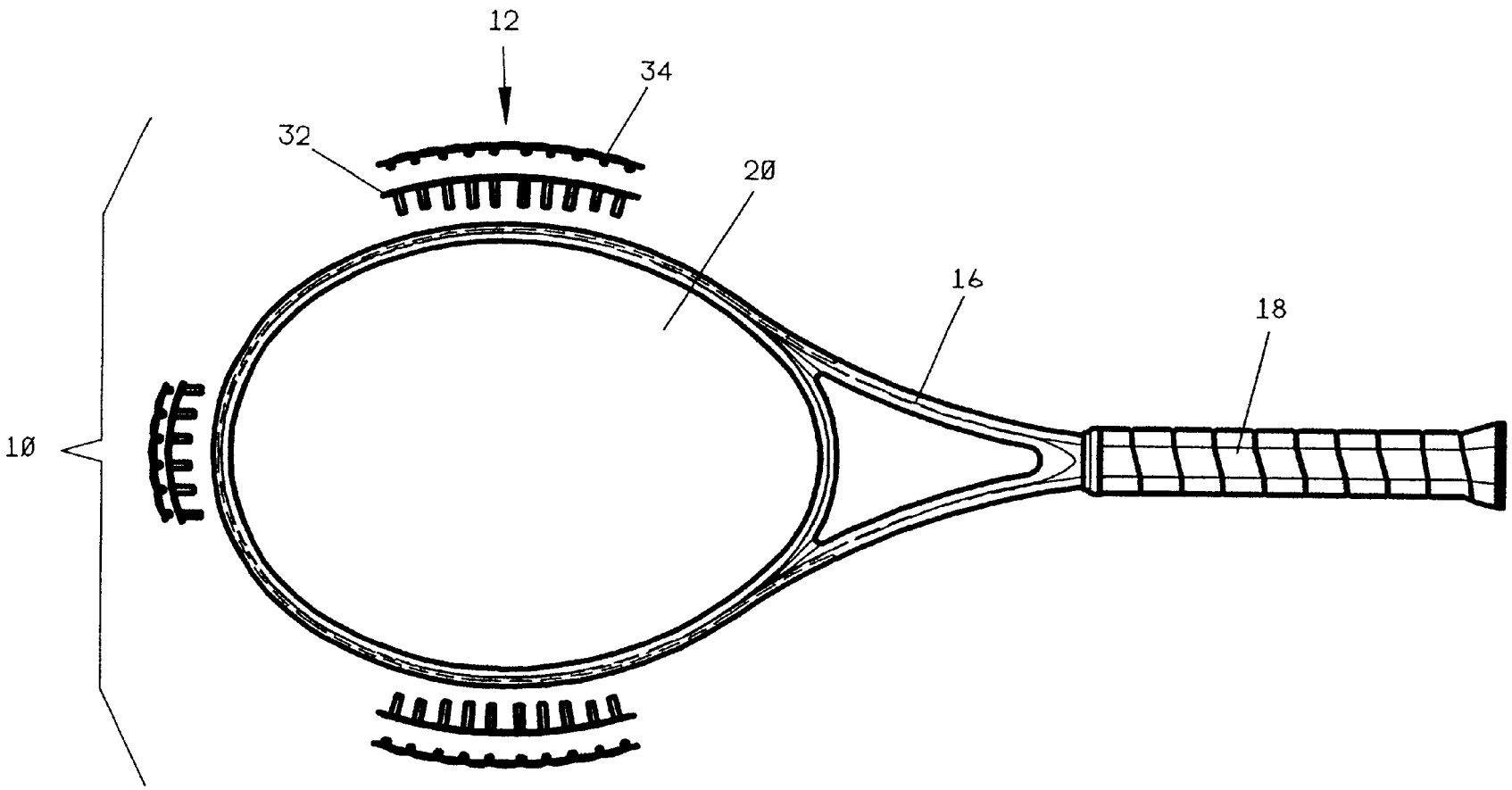
FIG. 6 is a front, exploded perspective view of a racquet in accordance with another alternative preferred embodiment of the present invention.

Referring to FIGS. 2 through 6, in alternative preferred embodiments one or more grommet assemblies 12 are positioned at various locations about the head portion 14 of the racquet 10. In FIG. 2, the grommet assemblies are positioned at approximately the six and twelve o'clock positions on the head portion 14. In FIG. 3, the grommet assembly is positioned at approximately the six o'clock position only on the head portion 14. In FIG. 4, the grommet assemblies 12 are shown at approximately the three, six and nine o'clock positions on the head portion 14. In FIG. 5, the grommet assemblies 12 are shown at approximately the three, six, nine and twelve o'clock positions on the head portion. In a particularly preferred embodiment, the grommet assemblies 12 positioned at the 3 and 9 o'clock positions on the head portion each include 10 individual grommets or barrels. Also in a particularly preferred embodiment, the grommet assemblies 12 positioned at the 6 and 12 o'clock positions on the head portion each include 6 individual grommets or barrels. In alternative preferred embodiments, the grommet assemblies can include one or more individual grommets or barrels. In FIG. 6, the grommet assemblies 12 are shown at approximately the three, twelve and nine o'clock positions on the head portion 14.

Figures 7, 8, 9, 10:
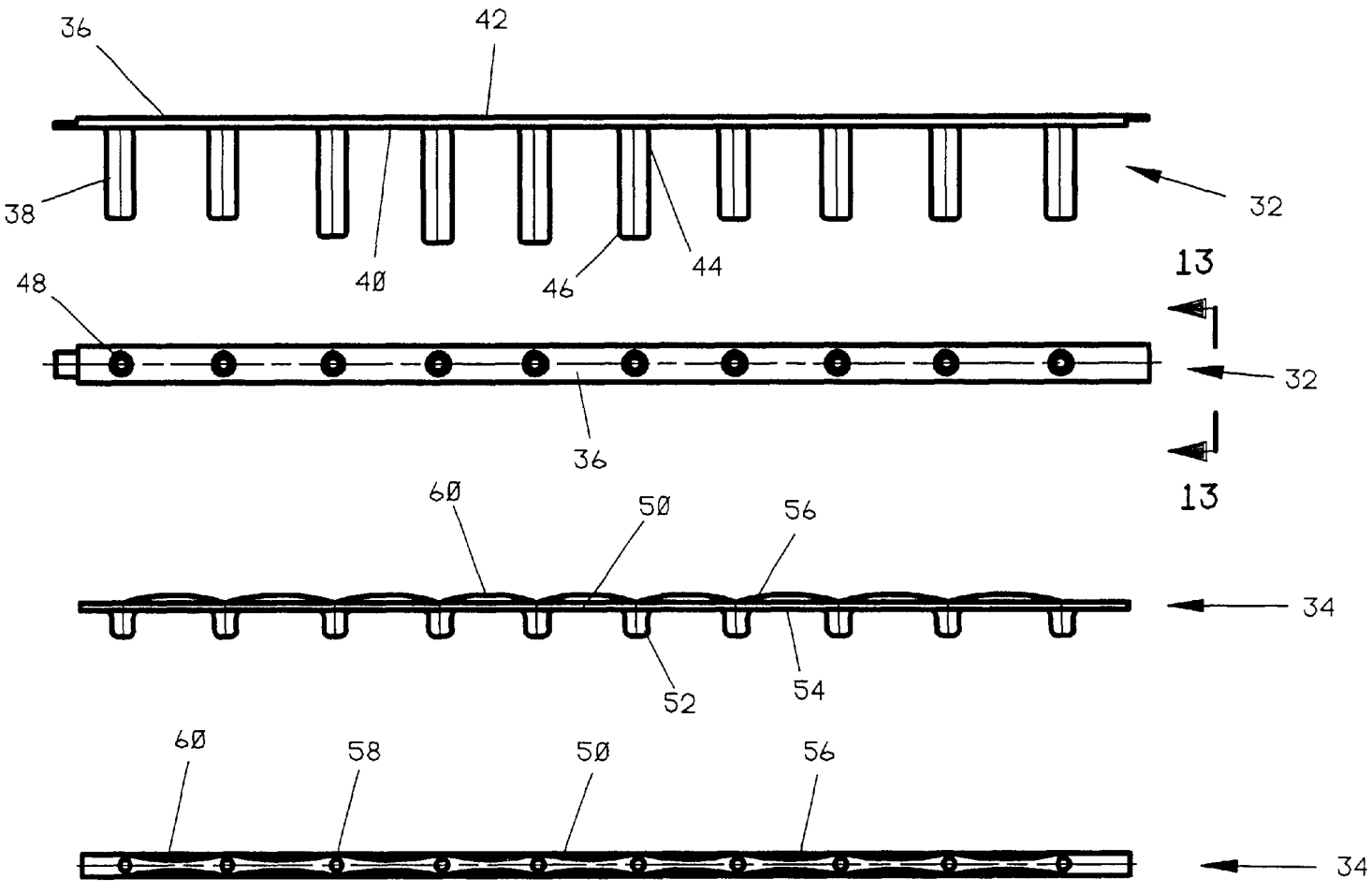
FIG. 7 is a side view of a first grommet member of the racquet of FIG. 1.
FIG. 8 is a top view of the first grommet member of FIG. 6.
FIG. 9 is a side view of a second grommet member of the racquet of FIG. 1.
FIG. 10 is a top view of the second grommet member of FIG. 8.

Referring to FIGS. 7 and 8, the first grommet member 32 of the grommet assembly 12 is shown in greater detail. The first grommet member 32 includes a first strip 36 and at least one barrel 38. The first strip 36 is a generally planar band having a first inner surface 40 and a first outer surface 42. The at least one barrel 38 extends inwardly and generally perpendicular from the first inner surface 40 of the first strip 36. In a preferred embodiment, the first strip 36 includes a plurality of barrels 38 that are spaced-apart along the first strip 36 to correspond with the spacing of the grommet holes 26 (see FIG. 11) on the head portion 14 of the racquet 10. In a preferred embodiment, the first strip 36 is integrally formed to the barrels 38. In alternative preferred embodiments, the barrels 38 can be attached to the first strip 36 through other means, such as, for example, snap-fit, thermal bonding, mechanical bonding, and adhesive bonding. Each barrel 38 is a generally cylindrical elongate body including a proximal portion 44 attached to the first strip 36 and a distal portion 46 configured to extend through one of the grommet holes 26 of the racquet 10. A first string hole 48 is defined through each barrel 38 of the first grommet assembly 32. Each first string hole 48 longitudinally extends through the first grommet member 32 from the first strip 36 through the distal portion 46 of the barrel 38.

The first grommet member 32 is made of a resilient, relatively soft first material, preferably a synthetic rubber. In alternative preferred embodiments, the first grommet member 32 can be made of other materials, such as, for example, a natural rubber, a urethane, an elastic polymeric material or combinations thereof. The first material preferably has good shock and vibration dampening properties. The first material also preferably has a durometer of less than 90 on the Shore A hardness scale (equivalent to less than approximately 39 on a Shore D hardness scale).

Referring to FIGS. 9 and 10, the second grommet member 34 of the grommet assembly 12 is shown in greater detail. The second grommet member 34 includes a second strip 50 and at least one peg 52. The second strip 50 is a generally planar band having a second inner surface 54 and a second outer surface 56. The at least one peg 52 is a generally cylindrical body that extends inwardly and generally perpendicular from the second inner surface 54 of the second strip 50. In a preferred embodiment, the at least on peg 52 is a plurality of pegs that are spaced-apart along the second strip 50 to correspond with the spacing of the barrels 38 of the first grommet member 32. In a preferred embodiment, the second strip 50 is integrally formed to the pegs 52. In alternative preferred embodiments, the pegs 52 can be attached to the second strip 50 through other means, such as, for example, snap-fit, thermal bonding, mechanical bonding, and adhesive bonding. A second string hole 58 is defined through each peg 52 of the second grommet assembly 34. Each second string hole 58 extends through the second grommet member 34 from the second strip 50 through the peg 52.

The second grommet member 34 also preferably includes a plurality of camel hump segments 60 outwardly extending from the second outer surface 56. Each segment of the second strip 50 between the pegs 52 preferably includes two generally parallel camel hump segments 60 configured to guide the racquet string 30 (see FIG. 11) between the pegs 52 and to limit lateral movement of the string 30 (see FIG. 11) within the grommet member 34. The camel hump segments 60 are also configured to provide additional stiffness and bending resistance to the grommet member 34.

The second grommet member 34 is made of a second material that is wear resistant and relatively hard. Preferably, the second material is a nylon. In a particularly preferred embodiment, the second material is a polyamide marketed under the trademark Rilsan and produced by Atofina of France. In alternative preferred embodiments, the second grommet member 34 can be made of other materials, such as, for example, a generally rigid polymer or a nylon. The wear resistant second material eliminates or substantially reduces the wear of the second grommet member 34 due to the stresses applied to, and movement of, the racquet string 30 along the second outer surface 56 of the second grommet member 34 during use. The significant reduction or elimination of wear of the second grommet member 34 enables the grommet assembly 12 to substantially reduce or eliminate the risk of premature string failure resulting from contact of the string with the head portion 14 of the frame. The second material preferably has a durometer of greater than 95 on the Shore A hardness scale (equivalent to greater than approximately 46 on the Shore D hardness scale).

In a preferred embodiment, the durometer of the first material is at least 10 increments below (or 10 increments softer than) the durometer of the second material on the Shore A hardness scale. In a particularly preferred embodiment, the first material has a durometer between 65 and 75 on the Shore A hardness scale and the second material has a durometer between 50 and 65 on the Shore D hardness scale. Additionally, the first and second grommet members 32 and 34 can be formed in the same or in different colors, and each of the first and second members 32 and 34 can be either single or multi-colored members. In an alternative preferred embodiment, the first and second materials for the first and second grommet members 32 and 34, respectively, are formed of the same type of material wherein the hardness of the first material is less than the hardness of the second material.

Figure 11:
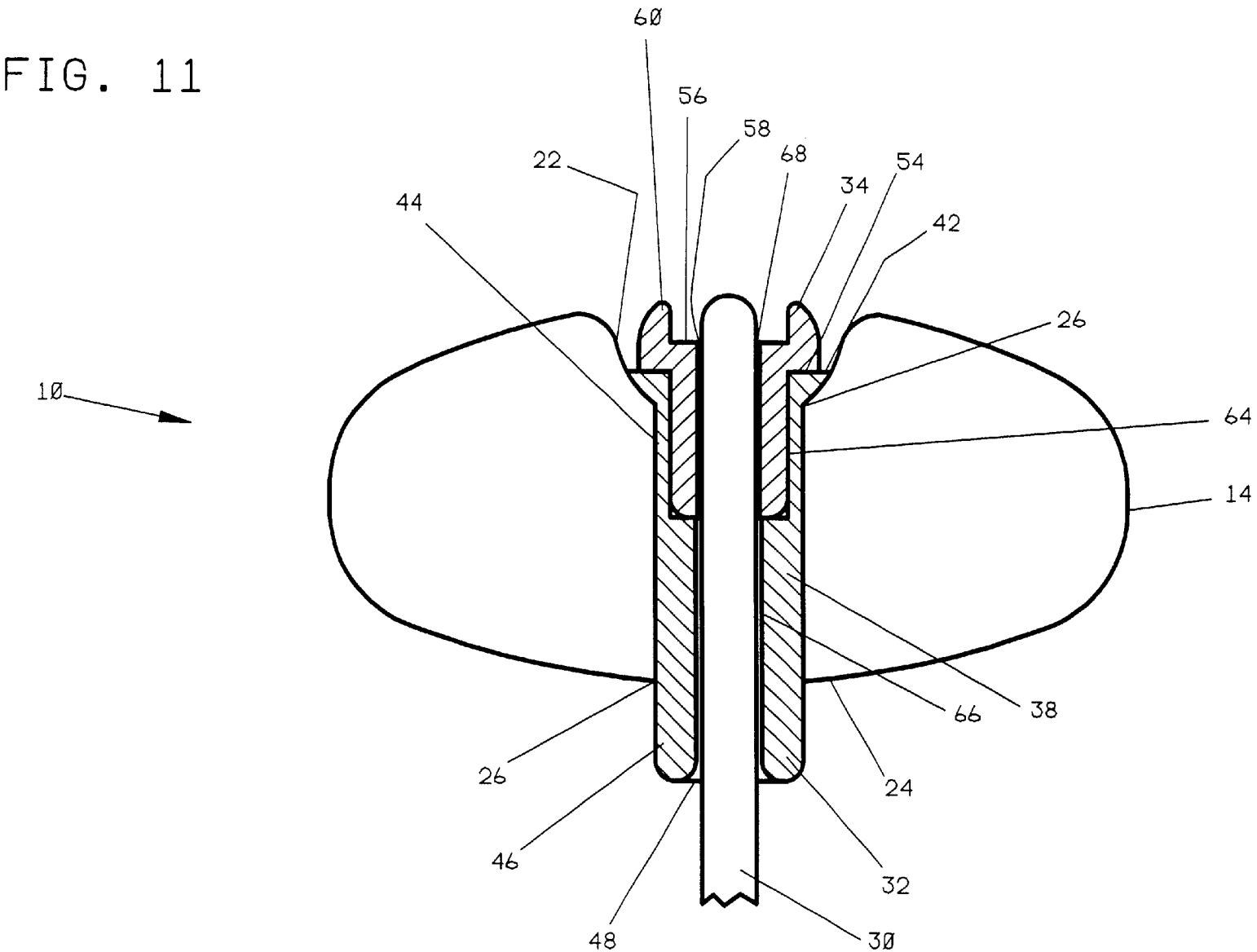
FIG. 11 is a transverse cross-sectional view of a portion of a head portion of the racquet of FIG. 1.

FIG. 11 illustrates the head portion 14 of the frame and the grommet assembly 12 in greater detail. The barrel 38 of the first grommet member 32 is removably inserted into the head portion 14 at the grommet hole 26 and through the outwardly and inwardly facing surfaces 22 and 24. The barrel 38 is sufficiently sized to substantially fill the grommet hole 26 through the outwardly and inwardly facing surfaces 22 and 24 of the head portion. The barrel 38 preferably is sized with sufficient length such that the distal portion 46 of the barrel 38 inwardly extends through the inwardly facing surface 24. In an alternative preferred embodiment, the barrels 38 are sized to extend through only the outwardly facing surface 22 of the head portion 14. The first string hole 48 of the barrel 38 preferably is a stepped bore having a large diameter portion 64 formed into the proximal portion 44 of the barrel 38 and a small diameter portion 66 formed into the distal portion 46 of the barrel 38. Each large diameter portion 64 of the string hole 48 is configured to removably receive one peg 52 from the second grommet member 34.

The peg 52 of the second grommet member 34 is preferably removably inserted into the large diameter portion 64 of the string hole 48 such that the first and second string holes 48 and 58 lie co-axially with respect to each other. The co-axial alignment of the first and second string holes 48 and 58 enables the string 30 to readily extend through the grommet assembly 12. The second inner surface 54 of the second strip 50 contacts the first outer surface 42 of the first strip 40. A groove 68 is formed into the second outer surface 56 of the second strip 50 to receive the string 30 and to support the string 30 as it extends on the outwardly facing surface 22 of the head portion 14 between grommet assemblies 12. The camel hump segments 60 are preferably spaced apart from either side of the string 30 and provide a limit for lateral movement of the string 30 within the second grommet member 34.

When the racquet strings 30 are impacted by a ball during use the axial and lateral loads placed onto the strings 30 are absorbed in part by the relatively soft first material of the first grommet member 32. Additionally, the shock and vibrational loads generated during impact with the ball are dampened by the first grommet member 32. The first grommet assembly 34 also substantially isolates the second grommet assembly 34 from contact with the head portion 14 to facilitate the dampening and dissipation of shock and vibrational energy produced from impact of the racquet 10 with a ball.

Figure 12:
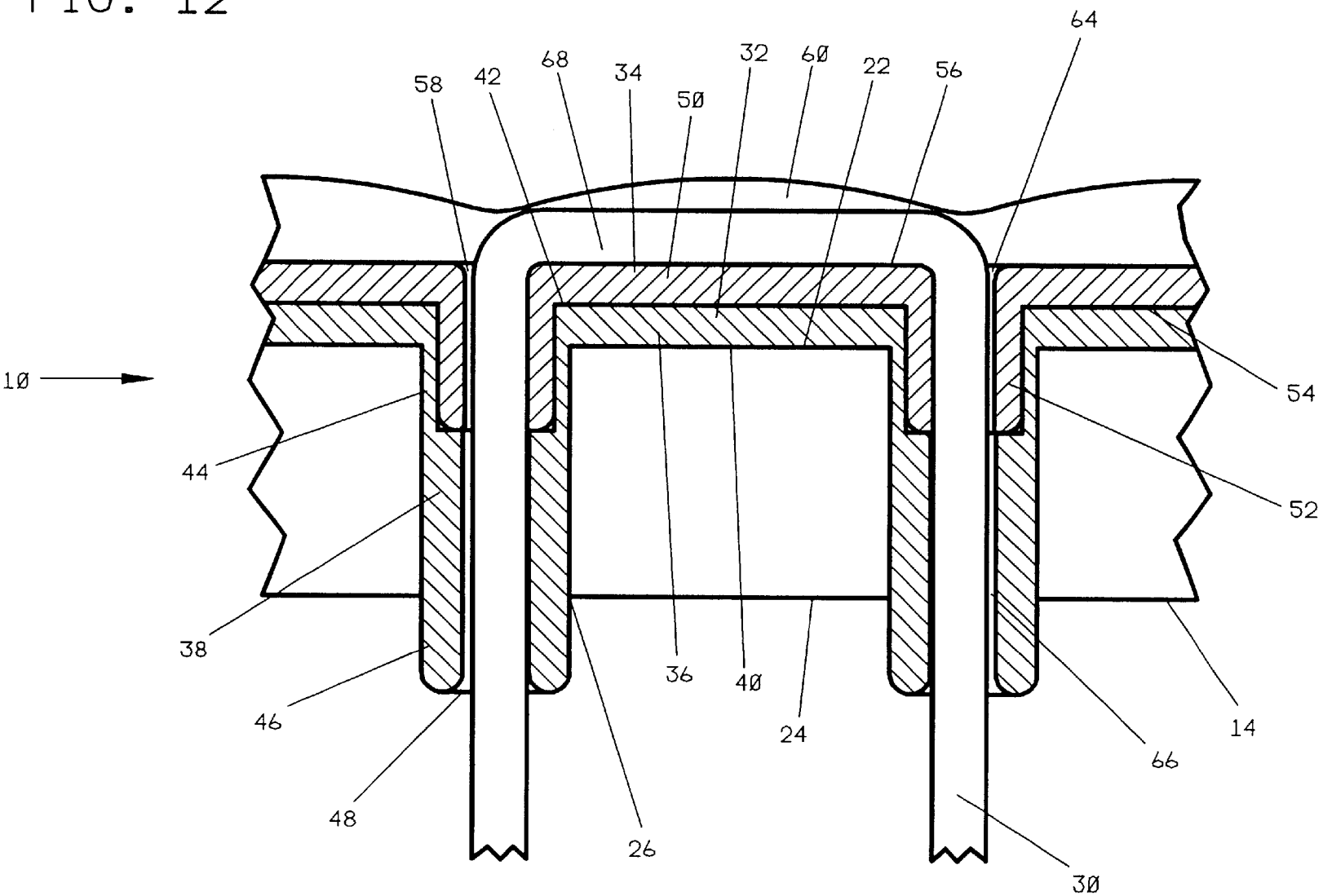
FIG. 12 is a longitudinal sectional view of the head portion of the racquet of FIG. 1.

Referring to FIG. 12, the head portion 14 and the grommet assembly 12 are shown in further detail. FIG. 12 is a longitudinal cross-sectional view of a portion of the head portion 14 of the racquet 10. FIG. 12 illustrates the string 30 bending approximately 90 degrees as it exits the first and second string holes 48 and 58 and contacts the groove 68 of the second grommet member 34. The string 30 then bends again, by approximately 90 degrees, as it re-enters the first string hole 48 of an adjacent barrel 38. These bending or transition portions of the string 30 are generally highly stressed during use and often are the location of string failure. The relatively hard and wear resistant material of the second grommet member 34 substantially reduces or eliminates the risk of string failure at these bending or transition locations by preventing the string 30 from wearing through the second grommet member 34 and, eventually, contacting the head portion 14, particularly at the roughened edges of the outwardly facing surface 22 and the grommet hole 26. Thus, the second grommet member 34 enables the grommet assembly 12 to be wear resistant in the highest wear location of the grommet assembly 12. The barrel 38 of the first grommet member 32 extends through the grommet hole 26 at the inwardly facing surface 24 further protecting the string 30 from the head portion 14.

Additionally, the grommet assembly 12 also provides shock and vibration dampening by separating or isolating the second inner surface 54 of the second grommet member 34 and the pegs 52 from the head portion 14 of the frame. The separation of the second grommet member 32 from the head portion 14 extends to the segment between the grommet holes 26. The second inner surface 54 of the second grommet member 34 does not directly contact the head portion 32 at any portion between the grommet holes 26. This separation or isolation is accomplished by placement of the first grommet member 32 between the second grommet member 34 and the head portion 14. The relatively soft and resilient material of the first grommet member 32 is advantageously selected to reduce the shock and vibrational energy passing from the strings 30 to the frame of the racquet 10. The material of the first grommet member 32 serves to absorb and/or dissipate a portion of the shock and vibrational energy generated from impact of the racquet strings 30 with a ball. Moreover, the shock and vibration dampening properties of the grommet assembly 12 also result is an improved, more comfortable feel for the user. Further, the grommet assembly 12 enables the racquet 10 to produce a more pleasing acoustic response during use that can enhance the user's experience with the racquet 10.

Figure 13:
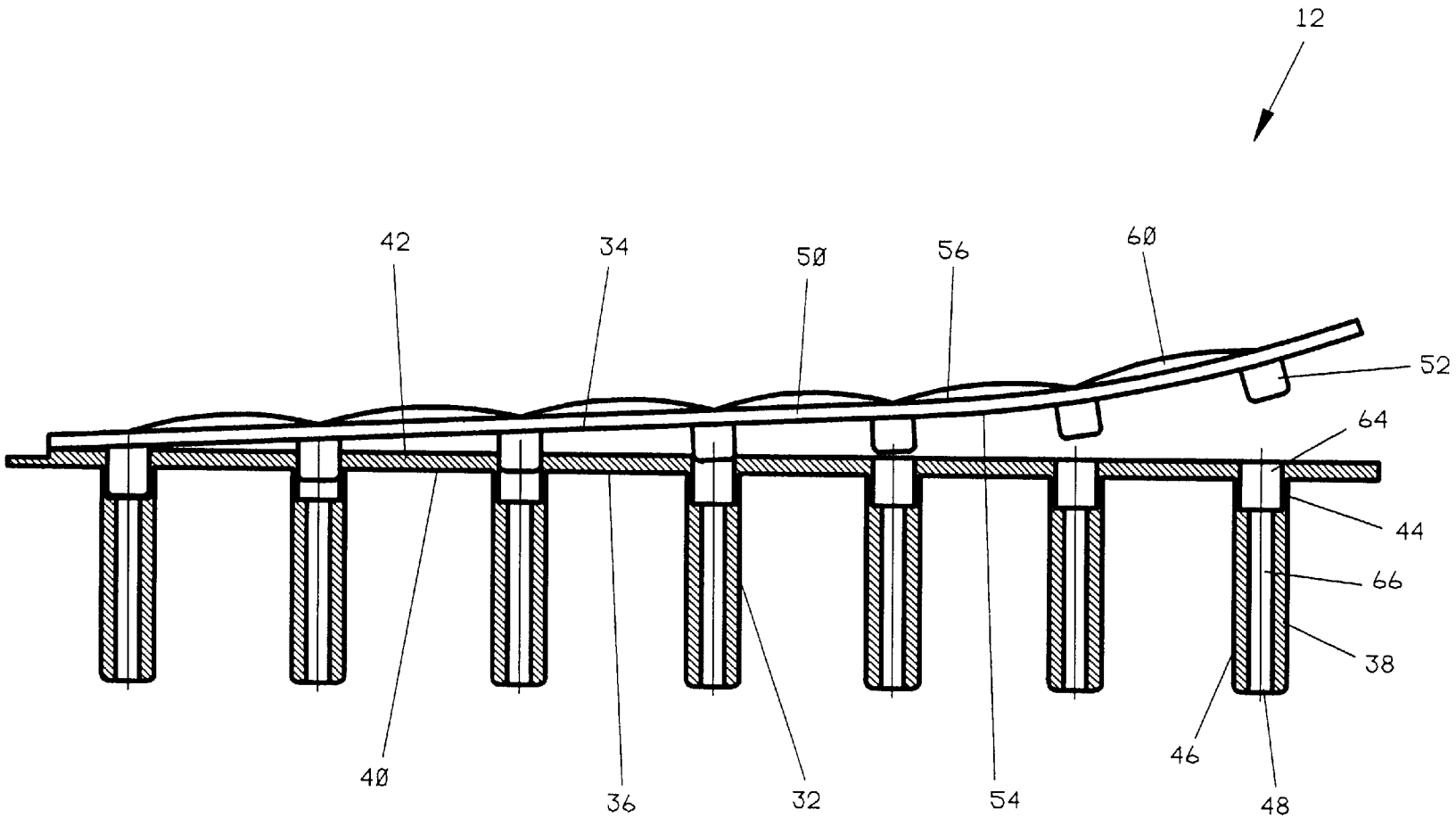
FIG. 13 is a side, partially exploded view of the grommet assembly of FIG. 1.

Referring to FIG. 13, the grommet assembly 12 is shown in greater detail. The pegs 52 of the second grommet member 34 are spaced apart along the second strip 50 such that the pegs 52 generally align with the location of the barrels 38 of the first grommet member 32. The pegs 52 are removably insertable into the large diameter portion 64 of the first string hole 48 of the barrels 38 such that the first and second string holes 48 and 58 are co-axially aligned and the first and second strips 36 and 50 contact each other. In an alternative preferred embodiment, the first and second members 32 and 34 can be formed through an injection molding process wherein the first and second member 32 and 34 are in a single molding process or separate molding processes. In alternative preferred embodiments, the second grommet member 34 can be engaged with the first grommet member 32 through other means, such as, for example, snap-fit connections or adhesive bonding.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A two-piece grommet assembly for a sports racquet, the sports racquet including a frame having a plurality of grommet holes and at least one racquet string, the grommet assembly comprising:

a first grommet member including a first strip having a first inner surface for contacting the frame and a first outer surface, and at least two spaced-apart barrels extending generally perpendicular from the first inner surface, each barrel including a first string hole extending along a longitudinal axis of the barrel, each barrel configured to extend through a separate grommet hole in the frame; and a second grommet member including a second strip having a second inner surface and a second outer surface, and at least two spaced-apart pegs extending generally perpendicular from the second inner surface, each peg having a second string hole, the second inner surface contacting the first outer surface and the pegs extending into generally only the proximal end of the barrels such that the first and second string holes are generally co-axially aligned, the first grommet member configured to substantially isolate the pegs and the second inner surface from the frame.

2. The grommet assembly of claim 1 wherein the second outer surface includes a groove for receiving the racquet string.

3. The grommet assembly of claim 1 wherein the first and second grommet members are formed in first and second colors, respectively, and wherein the first and second colors are selected from the group consisting of the same color and at least two different colors.

4. The grommet assembly of claim 1 wherein the first and second grommet members comprise first and second materials, respectively, and wherein the first material is softer than the second material.

5. The grommet assembly of claim 4 wherein the first material has a durometer of less than 90 on a Shore A hardness scale and wherein the second material has a durometer of greater than 95 on the Shore A hardness scale.

6. The grommet assembly of claim 5 wherein the first material has a durometer of between 65 and 75 on the Shore A hardness scale and the second material has a durometer of between 50 and 65 on the Shore D hardness scale.

7. The grommet assembly of claim 4 wherein the durometer of the first material is at least 10 increments below the durometer of the second material on the Shore A hardness scale.

8. The grommet assembly of claim 1 wherein each barrel has a distal end and a proximal end, wherein the first string hole of each barrel includes a large diameter portion at the proximal end of the barrel and a small diameter portion at the distal end of the barrel, and wherein the large diameter portion is sized to substantially receive one of the pegs.

9. The grommet assembly of claim 1 wherein the first grommet member is formed of a material selected from the group consisting of a natural rubber, a synthetic rubber, a urethane, an elastic polymeric material and combinations thereof.

10. The grommet assembly of claim 1 wherein the second grommet member is formed of a material selected from the group consisting of a nylon, a generally rigid polymer, a polyamide and combinations thereof.

11. A two-piece grommet assembly for a sports racquet, the sports racquet including a frame having a plurality of grommet holes and at least one racquet string, the grommet assembly comprising:

a first grommet member including a first strip having a first inner surface for contacting the frame and a first outer surface, and at least two spaced-apart barrels extending generally perpendicular from the first inner surface, each barrel including a first string hole extending along a longitudinal axis of the barrel, each barrel configured to extend through a separate grommet hole in the frame; and a second grommet member including a second strip having a second inner surface and a second outer surface, and at least two spaced-apart pegs extending generally perpendicular from the second inner surface, each peg having a second string hole, the second inner surface contacting the first outer surface and the pegs extending into the barrels such that the first and second string holes are generally co-axially aligned, the first grommet member configured to substantially isolate the pegs and the second inner surface from the frame, the first and second grommet members comprising first and second materials, respectively, and the first material being softer than the second material.

12. The grommet assembly of claim 11 wherein the first material has a durometer of less than 90 on a Shore A hardness scale and wherein the second material has a durometer of greater than 95 on the Shore A hardness scale.

13. The grommet assembly of claim 12 wherein the durometer of the first material is at least 10 increments below the durometer of the second material on the Shore A hardness scale.

14. The grommet assembly of claim 12 wherein the first material has a durometer of between 65 and 75 on the Shore A hardness scale and the second material has a durometer of between 50 and 65 on the Shore D hardness scale.

15. A two-piece grommet assembly for a sports racquet, the sports racquet including a frame having a plurality of grommet holes and at least one racquet string, the grommet assembly comprising:

a first grommet member including a first strip having a first inner surface for contacting the frame and a first outer surface, and at least two spaced-apart barrels extending generally perpendicular from the first inner surface, each barrel including a first string hole extending along a longitudinal axis of the barrel, each barrel configured to extend through a separate grommet hole in the frame; and a second grommet member including a second strip having a second inner surface and a second outer surface, and at least two spaced-apart pegs extending generally perpendicular from the second inner surface, each peg having a second string hole, the second inner surface contacting the first outer surface and the pegs extending into the barrels such that the first and second string holes are generally co-axially aligned, the first grommet member configured to substantially isolate the pegs and the second inner surface from the frame, each barrel having a distal end and a proximal end, the first string hole of each barrel including a large diameter portion at the proximal end of the barrel and a small diameter portion at the distal end of the barrel, and the large diameter portion being sized to substantially receive one of the pegs.

16. A two-piece grommet assembly for a sports racquet, the sports racquet including a frame having a plurality of grommet holes and at least one racquet string, the grommet assembly comprising:

a first grommet member including a first strip having a first inner surface for contacting the frame and a first outer surface, and at least two spaced-apart barrels extending generally perpendicular from the first inner surface, each barrel including a first string hole extending along a longitudinal axis of the barrel, each barrel configured to extend through a separate grommet hole in the frame; and a second grommet member including a second strip having a second inner surface and a second outer surface, and at least two spaced-apart pegs extending generally perpendicular from the second inner surface, each peg having a second string hole, the second inner surface contacting the first outer surface and the pegs extending into the barrels such that the first and second string holes are generally co-axially aligned, the first grommet member configured to substantially isolate the pegs and the second inner surface from the frame, the first grommet member being formed of a material selected from the group consisting of a natural rubber, a synthetic rubber, a urethane, an elastic polymeric material and combinations thereof.

17. The grommet assembly of claim 16 wherein the second grommet member is formed of a material selected from the group consisting of a nylon, a generally rigid polymer, a polyamide and combinations thereof.

18. A sports racquet having at least one racquet string, the racquet comprising:

a frame including a head portion with an outwardly facing surface and an inwardly facing surface that defines a generally oval stringing area, the head portion including a plurality of grommet holes, each grommet hole extending through the outwardly facing surface and the inwardly facing surface along an axis;

a two-piece grommet assembly connected to the head portion, the grommet assembly including, a first member including a first strip having a first inner surface, for contacting the outwardly facing surface, and a first outer surface, and at least two spaced-apart barrels extending generally perpendicular from the first inner surface, each barrel extending through a separate grommet hole in the head portion and having a first string hole extending from a proximal end of the barrel to a distal end of the barrel, and a second grommet member including a second strip having a second inner surface and a second outer surface, and at least two spaced-apart pegs extending generally perpendicular from the second inner surface, each peg having a second string hole, the second inner surface contacting the first outer surface and the pegs extending into the barrels such that the first and second string holes are generally co-axially aligned, the first grommet member configured to substantially isolate the pegs and the second inner surface from the frame; and at least one string extending through the first and second string holes, the racquet string contacting at least a portion of the barrel of the first grommet member.

19. The sports racquet of claim 18 wherein the second outer surface includes a groove for receiving the racquet string.

20. The sports racquet of claim 18 wherein the first and second grommet members are formed in first and second colors, respectively, and wherein the first and second colors are selected from the group consisting of the same color and at least two different colors.

21. The sports racquet of claim 18 wherein the first and second grommet members comprise first and second materials, respectively, and wherein the first material is softer than the second material.

22. The sports racquet of claim 21 wherein the first material has a durometer of less than 90 on a Shore A hardness scale and wherein the second material has a durometer of greater than 95 on the Shore A hardness scale.

23. The grommet assembly of claim 22 wherein the first material has a durometer of between 65 and 75 on the Shore A hardness scale and the second material has a durometer of between 50 and 65 on the Shore D hardness scale.

24. The sports racquet of claim 21 wherein the durometer of the first material is at least 10 increments below the durometer of the second material on the Shore A hardness scale.

25. The sports racquet of claim 18 wherein the first string hole of each barrel includes a large diameter portion at the proximal end of the barrel and a small diameter portion at the distal end of the barrel, and wherein the large diameter portion is sized to substantially receive one of the pegs.

26. The sports racquet of claim 18 wherein the first grommet member is formed of a material selected from the group consisting of a natural rubber, a synthetic rubber, a urethane, an elastic polymeric material and combinations thereof.

27. The sports racquet of claim 18 wherein the second grommet member is formed of a material selected from the group consisting of a nylon, a generally rigid polymer, a polyamide and combinations thereof.

28. A sports racquet comprising:

a frame including a head portion with an outwardly facing surface and an inwardly facing surface that defines a generally oval stringing area, the head portion including a plurality of grommet holes, each grommet hole extending through the outwardly facing surface and the inwardly facing surface along an axis;

a two-piece grommet assembly connected to the head portion, the grommet assembly including, a first member including a first strip having a first inner surface, for contacting the outwardly facing surface, and a first outer surface, and at least two spaced-apart barrels extending generally perpendicular from the first inner surface, each barrel extending through a separate grommet hole in the head portion and having a first string hole extending from a proximal end of the barrel to a distal end of the barrel, and a second grommet member including a second strip having a second inner surface and a second outer surface, and at least two spaced-apart pegs extending generally perpendicular from the second inner surface, each peg having a second string hole, the second inner surface contacting the first outer surface and the pegs extending into the barrels such that the first and second string holes are generally co-axially aligned, the first grommet member configured to substantially isolate the pegs and the second inner surface from the frame; and at least one string extending through the first and second string holes, the first and second grommet members comprising first and second materials, respectively, and the first material being softer than the second material.

29. The sports racquet of claim 12 wherein the first material has a durometer of less than 90 on a Shore A hardness scale and wherein the second material has a durometer of greater than 95 on the Shore A hardness scale.

30. The sports racquet of claim 29 wherein the durometer of the first material is at least 10 increments below the durometer of the second material on the Shore A hardness scale.

31. The grommet assembly of claim 29 wherein the first material has a durometer of between 65 and 75 on the Shore A hardness scale and the second material has a durometer of between 50 and 65 on the Shore D hardness scale.

32. A sports racquet comprising:

a frame including a head portion with an outwardly facing surface and an inwardly facing surface that defines a generally oval stringing area, the head portion including a plurality of grommet holes, each grommet hole extending through the outwardly facing surface and the inwardly facing surface along an axis;

a two-piece grommet assembly connected to the head portion, the grommet assembly including, a first member including a first strip having a first inner surface, for contacting the outwardly facing surface, and a first outer surface, and at least two spaced-apart barrels extending generally perpendicular from the first inner surface, each barrel extending through a separate grommet hole in the head portion and having a first string hole extending from a proximal end of the barrel to a distal end of the barrel, and a second grommet member including a second strip having a second inner surface and a second outer surface, and at least two spaced-apart pegs extending generally perpendicular from the second inner surface, each peg having a second string hole, the second inner surface contacting the first outer surface and the pegs extending into the barrels such that the first and second string holes are generally co-axially aligned, the first grommet member configured to substantially isolate the pegs and the second inner surface from the frame; and at least one string extending through the first and second string holes, the first string hole of each barrel including a large diameter portion at the proximal end of the barrel and a small diameter portion at the distal end of the barrel, and the large diameter portion being sized to substantially receive one of the pegs.

33. A sports racquet comprising:

a frame including a head portion with an outwardly facing surface and an inwardly facing surface that defines a generally oval stringing area, the head portion including a plurality of grommet holes, each grommet hole extending through the outwardly facing surface and the inwardly facing surface along an axis;

a two-piece grommet assembly connected to the head portion, the grommet assembly including, a first member including a first strip having a first inner surface, for contacting the outwardly facing surface, and a first outer surface, and at least two spaced-apart barrels extending generally perpendicular from the first inner surface, each barrel extending through a separate grommet hole in the head portion and having a first string hole extending from a proximal end of the barrel to a distal end of the barrel, and a second grommet member including a second strip having a second inner surface and a second outer surface, and at least two spaced-apart pegs extending generally perpendicular from the second inner surface, each peg having a second string hole, the second inner surface contacting the first outer surface and the pegs extending into the barrels such that the first and second string holes are generally co-axially aligned, the first grommet member configured to substantially isolate the pegs and the second inner surface from the frame; and at least one string extending through the first and second string holes, the first grommet member being formed of a material selected from the group consisting of a natural rubber, a synthetic rubber, a urethane, an elastic polymeric material and combinations thereof.

34. The sports racquet of claim 33 wherein the second grommet member is formed of a material selected from the group consisting of a nylon, a generally rigid polymer, a polyamide and combinations thereof.

35. A two-piece grommet assembly for a sports racquet, the sports racquet including a frame having a plurality of grommet holes and at least one racquet string, the grommet assembly comprising:

a first grommet member being made of a first material selected from the group consisting of a natural rubber, a synthetic rubber, a thermoplastic urethane, an elastic polymeric material and combinations thereof, the first grommet member including a first strip having a first inner surface and a first outer surface, and at least one barrel extending generally perpendicular from the first inner surface, each barrel including a first string hole extending along a longitudinal axis of the barrel, each barrel configured to extend through a separate grommet hole in the frame; and a second grommet member being made of a second material, the second grommet member including a second strip having a second inner surface and a second outer surface, and at least two spaced-apart pegs extending generally perpendicular from the second inner surface, each peg having a second string hole, the second inner surface contacting the first outer surface and the pegs extending into the barrels such that the first and second string holes are generally co-axially aligned, the first material having a durometer on a Shore A hardness scale that is less than the durometer of the second material on one of the Shore A hardness scale.

36. The grommet assembly of claim 35 wherein the first material has a durometer of less than 90 on a Shore A hardness scale and wherein the second material has a durometer of greater than 95 on the Shore A hardness scale.

37. The grommet assembly of claim 36 wherein the durometer of the first material is at least 10 increments below the durometer of the second material on the Shore A hardness scale.

38. The grommet assembly of claim 36 wherein the first material has a durometer of between 65 and 75 on the Shore A hardness scale and the second material has a durometer of between 50 and 65 on the Shore D hardness scale.

39. The grommet assembly of claim 35 wherein the at least one barrel comprises two or more spaced-apart barrels such that the barrels generally correspond with the spacing of the grommet holes.

40. The grommet assembly of claim 35 wherein each barrel has a distal end and a proximal end, wherein the first string hole of each barrel includes a large diameter portion at the proximal end of the barrel and a small diameter portion at the distal end of the barrel, and wherein the large diameter portion is sized to substantially receive one of the pegs.

41. The grommet assembly of claim 35 wherein the second outer surface includes a groove for receiving the racquet string.

42. The grommet assembly of claim 35 wherein the first and second grommet members are formed in first and second colors, respectively, and wherein the first and second colors are selected from the group consisting of the same color and at least two different colors.

* * * * *